US006182387B1

(12) United States Patent
Duguay

(10) Patent No.: US 6,182,387 B1
(45) **Date of Patent: *Feb. 6, 2001**

(54) MAGNETIC MENU BOARD

(75) Inventor: Eloi Duguay, Edmunston (CA)

(73) Assignee: Enseignes Imperial Signs Ltee/Ltd. (CA)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/245,241

(22) Filed: Feb. 5, 1999

(30) Foreign Application Priority Data

Apr. 9, 1998 (CA) ..... 2246523

(51) Int. Cl.[7] ..... G09F 7/04
(52) U.S. Cl. ..... 40/621; 40/600
(58) Field of Search ..... 40/621, 600, 711; 248/206.5

(56) References Cited

U.S. PATENT DOCUMENTS 5,269,083 * 12/1993 Vampatella et al. ..... 40/621
5,787,622 * 8/1998 Green et al. ..... 40/621

FOREIGN PATENT DOCUMENTS 1257475 7/1989 (CA) .

* cited by examiner

*Primary Examiner*—Cassandra H. Davis
(74) *Attorney, Agent, or Firm*—Anthony J. Casella; Gerald E. Hespos; Michael J. Porco

(57) ABSTRACT

A menu board system comprising a support structure, made of magnetically attractable material, and various strips indicating, for instance, products sold and magnetic elements indicating prices at which products are sold. Once all the elements and strips are in place on the support structure, the front surface of the menu board seems flat and continuous as all pieces are cut to fit perfectly in an edge-to-edge pattern. The price elements are easily removed by simply pressing an element's bottom portion allowing the top portion to lift off the support structure. The ease of removal is caused by a magnet fixed only to the top portion of the back surface of the price element. The bottom edge of the magnet acts as a fulcrum point and the back surface of the element left uncovered is simply pushed into the support structure, permitting the top portion of the element to be grasped.

4 Claims, 4 Drawing Sheets

MAGNETIC MENU BOARD

The present invention relates to the field of signage. In particular the present invention provides an improved pricing or menu board for use in restaurants, or other small businesses. For exemplary purposes, the term menu board is used herein, but it will be understood that the present invention is equally applicable to any pricing or product information board used in business for presenting product information to customers.

BACKGROUND OF THE INVENTION

Businesses such as restaurants in the fast food and beverage business, particularly coffee shops, are not often able to hand out their menu or other pricing materials to their clientele. The alternative is a menu board which is usually hung behind a counter and on which a complete listing of all the products are advertised for the clientele to see. These menu boards come in various form from chalk on a blackboard to interior-illuminated plastic boards. It is important that the prices and products be easily interchangeable as items on a menu and their prices can vary greatly and frequently can change. Another important aspect is the aesthetics of the menu board. By hanging a menu behind the counter, it becomes an integral part of a restaurant's interior decor and as such requires features that are pleasing to the eye. Simplicity in the design renders the menu board more appealing. A flat and continuous surface makes the menu board appear neat and uncluttered, making it easier for the clientele to identify the products and their price, without taking away from the attractiveness of the decor.

There are various methods of obtaining a flat and continuous menu board: blackboard with chalk, white board with marker, flat plastic front panel with interior-illumination, magnetized strips, etc. The prices on the black and white boards can easily be changed by erasing the previous price or product and rewriting the new information. This requires someone with neat and artistic hand-writing to maintain a professional and pleasant look. It is difficult to maintain the same lettering if more than one person is to execute the changes. Furthermore, it takes a long of time to complete the board and then to modify it every time a price or product would change. The illuminated signs are permanent and cannot be changed without replacing the entire facade of the menu, a costly and time consuming affair.

Magnetized strips can be used if they are cut to fit edge-to-edge and then placed onto a back portion (with magnetically attractable material) thereby forming a completely flat surface. However, each strip must be adapted to fit well with all other pieces so as to be able to completely cover the back portion with strips indicating products and prices without leaving any spaces between the strips. Once that is accomplished, there must be an easy way to remove and replace any of the strips without removing a great number of them, without causing damage to any part of the menu board system.

Canadian patent 1,257,475 to Kane describes a changeable display sign which uses magnetized pieces and strips that fit onto a back portion and which form a flat and continuous surface. However, once all the strips and pieces are put together, they are not easily removed because their edges are pressed together. The patent discloses a sharp tool or suction cup to be used to remove the pieces from the board. Pieces may thus be damaged around the edges and therefore have a short useful life. The sharp edges of a knife or a screwdriver may also damage the back portion of the menu board by scratching it. This may eventually interfere with the magnetized pieces and prevent the strips from lining up properly.

Therefore a device or system which overcomes the drawbacks of known menu board signage is desired.

SUMMARY OF THE INVENTION

An object of the present invention is to provide a magnetic menu board with an improved method of removing the pieces thereof having products or prices listed thereon and replacing them with pieces listing new products or prices.

In accordance with one aspect of the current invention there is provided a menu board assembly, comprising: a support portion made of magnetically attractable material; a plurality of magnetic strips removably attachable to the support portion, comprising a front surface which contains information and a back surface which is covered by a magnet strip fixed onto said back surface; a plurality of magnetic elements removably attachable to the support portion, comprising a front surface which contains information and a back surface onto which a magnet is fixed, said magnetic element being removable by applying pressure to a bottom half of said magnetic element thereby causing the magnet fixed onto the back surface to act as a fulcrum and thereby causing a top portion of said magnet to be detached from said support portion and allowing said magnetic element to be grasped by its top edge; and said magnet being fixed on a top portion of the back surface of said magnetic element thus allowing a sufficient bottom portion of said back surface of said magnetic element to remain uncovered, a bottom edge of said magnet acting as said fulcrum point about which said bottom half of said magnetic element turns towards said support portion and about which a top half of said magnetic element turns away from said support portion to be grasped and removed from said support portion.

BRIEF DESCRIPTION OF THE DRAWINGS

The present invention will be further understood from the following description with reference to the drawings in which.

DETAILED DESCRIPTION

Figure 6:
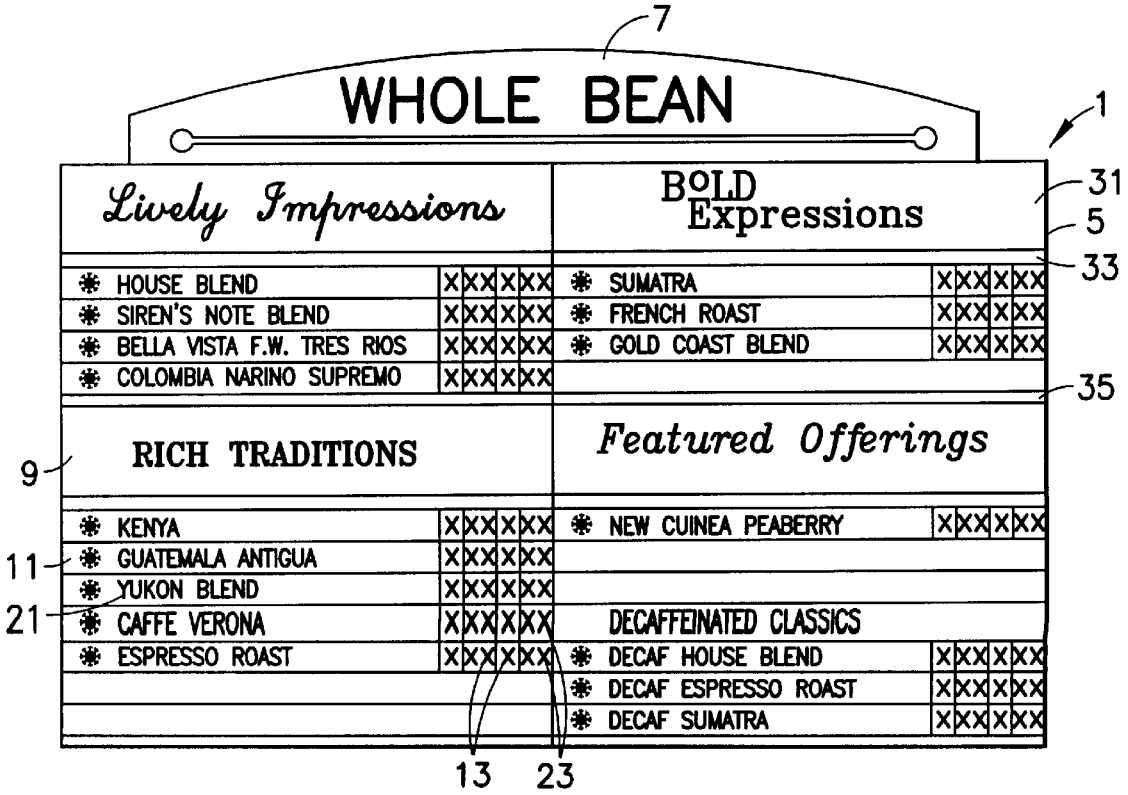
FIG. 6 is a front view of the signboard support of the present invention, after application of india pieces.

Referring to FIG. 6, there is illustrated a menu board 1 which is attachable to a wall behind a counter in a restaurant or coffee shop. The menu board 1 comprises a support portion 5 and menu name 7. The front surface 9 of menu board 1 comprises various magnetic strips 11 and magnetic price elements 13 that indicate products 21 and prices 23 for said products respectively. Other magnetic pieces 31, 33, 35 of various sizes also form part of and fill in front surface 9.

Figure 5:
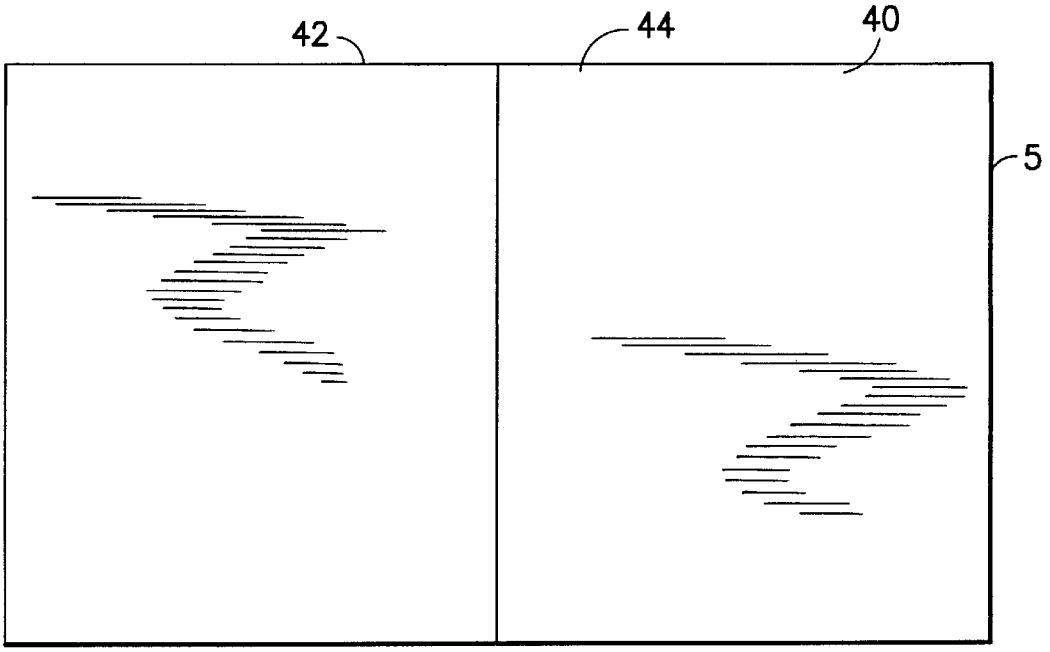
FIG. 5 is a front view of a signboard support according to the present invention, before application of indicia pieces.

Referring to FIG. 5, there is illustrated support portion 5 comprising a magnetically attractable uniform surface 40 completely surrounded by a margin 42. Margin 42 which extends past surface 40 a distance equal to the total thickness of the magnetic strips 11 and magnetic price elements 13 described below. Margin 42 allows the magnetic pieces to be properly aligned and parallel to the horizontal edges of the board 1. A magnetic strip 11, magnetic price element 13, or any other magnetic piece that are used with the board, when attached to the magnetically attractable surface 40 of support portion 5, is properly aligned by placing a top edge 50 of a magnetic strip 11, magnetic price element 13 or any other magnetic piece along the inside top edge 44 of margin 42.

Figure 1:
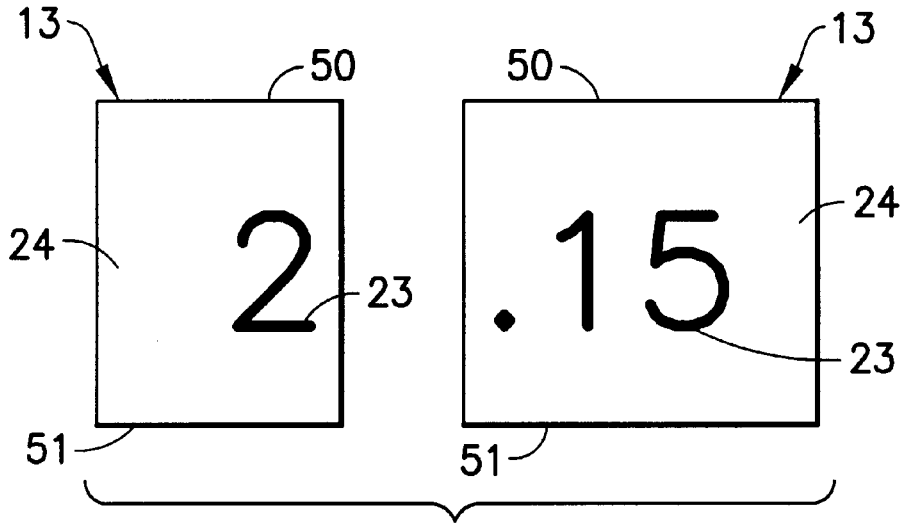
FIG. 1 illustrates a frontal view of a dollar price indicia piece and a cent price indicia piece according to the present invention.
Figure 2:
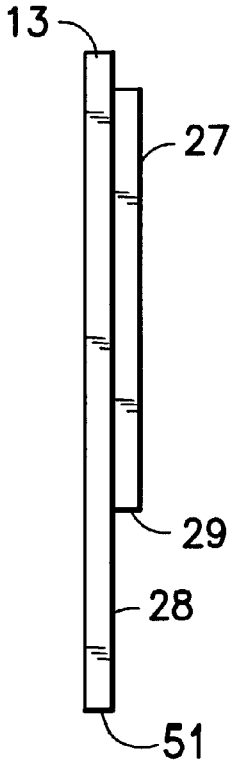
FIG. 2 illustrates a side view of a price indicia element showing the magnetic element placed on the top portion of the price indicia element.
Figure 3:
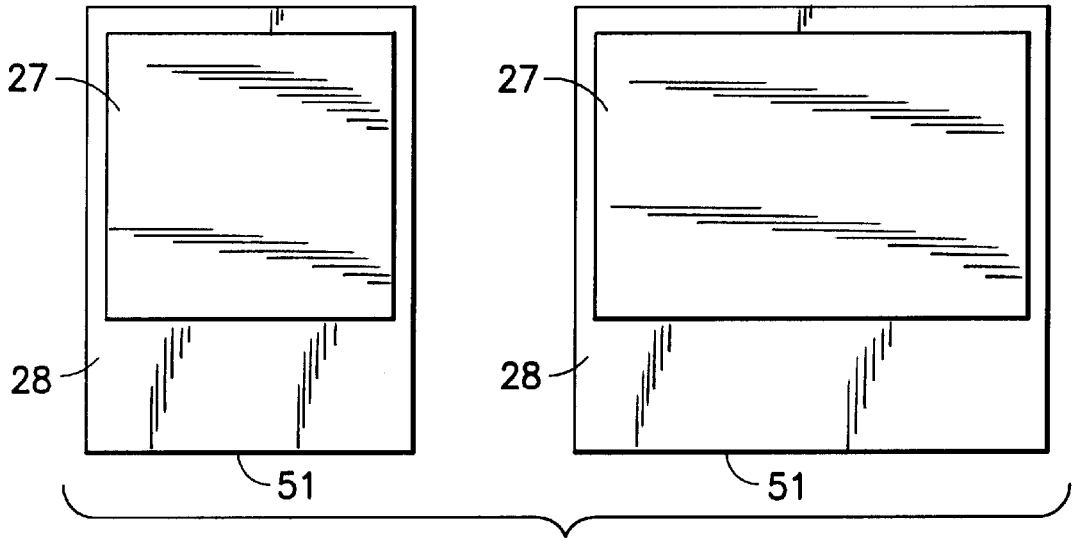
FIG. 3 is a rear view of the indicia pieces of FIG. 1.
Figure 4:
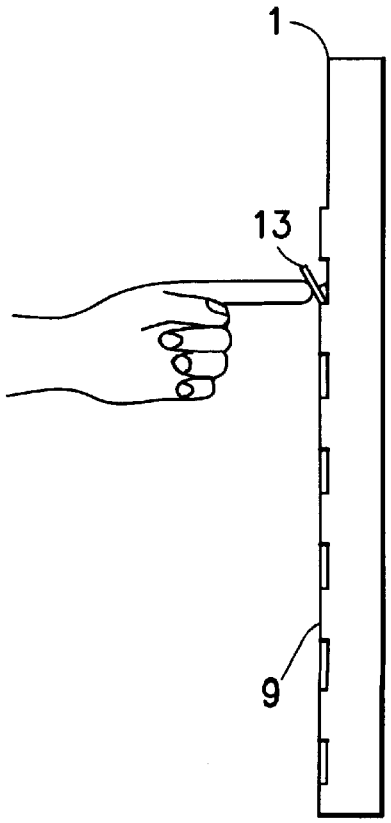
FIG. 4 illustrates a side view of the method used to remove the indicia price elements with a finger.

Referring to FIGS. 1, 2 and 3, there are illustrated magnetic price elements 13 which are made of formica or any like material and, for the most part, are of the same height H. Prices 23 of the products sold in the store are printed onto a front surface 24 of the magnetic price elements 13 with paint or any other substance. A magnet 27 is fixed to a back surface 28 of the magnetic price element, leaving uncovered a lower portion of back surface 28. In a preferred embodiment, the magnet 27 covers only approximately the top two-thirds (⅔) of the back surface 28. This is done to allow the bottom edge 29 of the magnet 27 to act as a fulcrum point about which the bottom portion of the magnetic price element 13 pivots when a force is exerted on the bottom of front surface 24. FIG. 4 demonstrates how a magnetic price element is removed by pressing a finger on the bottom portion of the price element 13 thereby causing its bottom edge 51 to touch the support portion 5 and its top edge 50 to lift off the support portion 5 in a position where it can be grasped and taken off the support portion 5. However, magnet 27 could be as narrow to cover only about one-half (½) of the back surface 28 and as wide as to cover five-sixths (⅚). More force will be required with a wider magnet 27 since the moment arm (distance between the bottom edge 29 of the magnet 27 and the bottom edge 51 of the price element 13) is fairly short. However, with a shorter moment arm, the element 13 will lift further off the support portion than with a longer moment arm making it easier to grasp price element 13. A longer moment arm (narrower magnet i.e. substantially less than one-half of the back surface 28) will generally not cause the price element 13 to lift far enough off the support portion 5 to allow a person to grasp the element in order to remove it.

Figure 7:
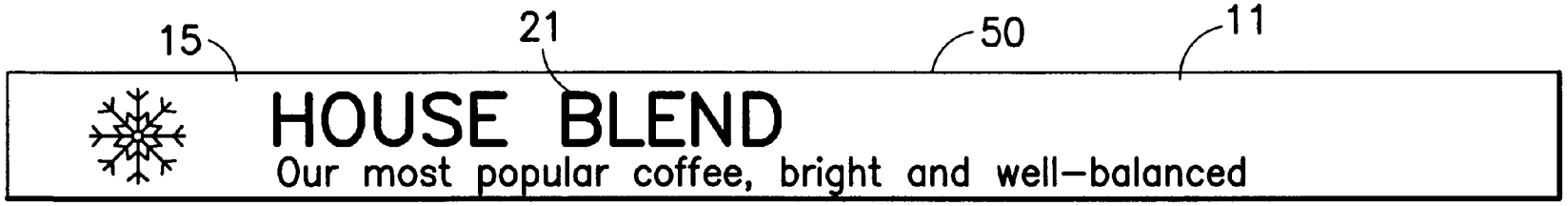
FIG. 7 is the front view of a strip of indicia for application to the signboard of FIG. 5.
Figure 8:
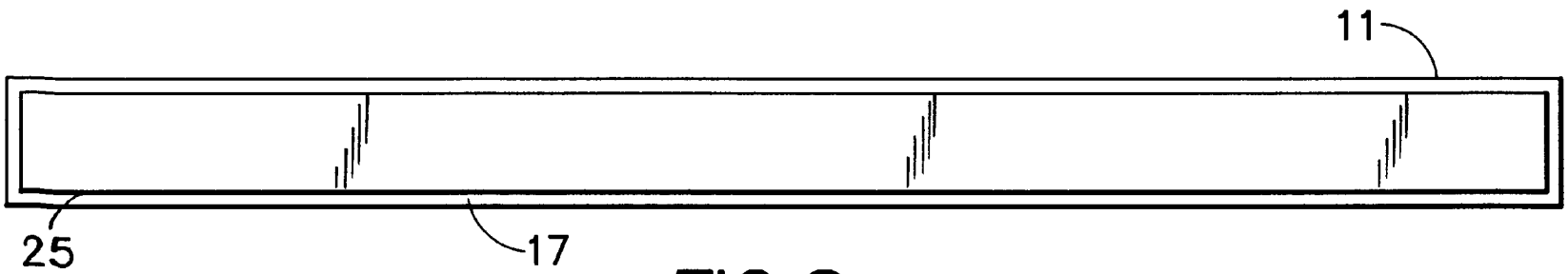
FIG. 8 is a rear view of the strip of FIG. 7.

Referring to FIGS. 7 and 8, there is illustrated a magnetic strip 11 which is made of the same material as the magnetic price elements 13. Products 21 sold in the store are printed onto a front surface 15 of the magnetic strips 11 with paint or any other substance. A magnet 25 is attached to a back surface 17 of the magnetic strip 11 to cover substantially all of said back portion.

Other magnetic strips 31, 33, 35 are constructed in the same manner and are of various sizes. Since magnetic strips 11, 31, 33 and 35 can be grasped by one of their edges when an adjacent magnetic piece is removed, there is no need for said strips to have a magnet placed only on their top portion as in the magnetic price elements. All that is required to remove said strips is to remove an adjacent price element 13.

In order to operate the magnetic menu board 1, a top magnetic element 31 is placed with its top edge 50 immediately against inside top edge 44 of said margin 42 and covering the entire width of the board 1. Thus, the top magnetic element is aligned perfectly with the top edge 44 of margin 42 of back portion 5. Subsequently, a magnetic strip 33, which indicates the units of the products sold, is placed with its top edge 50 adjacent and aligned with a bottom edge 51 of top magnetic element 31. Because both these elements are the same thickness, the seam that is formed between them is substantially visually indistinguishable. Magnetic strips 11 are then installed with their top edges 50 being aligned and touching the bottom edge 51 of the previous strip, from the top to the bottom. Once this is done, one half of the products to be advertised are indicated on the menu board from the top to the bottom, with a flat and continuous finish. The magnetic price elements 13 are then removably attached to the back portion 5, with (for North American purposeds a dollar amount price element and a cent amount price element being subsequently placed at the right edge of the magnetic strip indicating a first product. Similarly to the magnetic strips 11, 31 and 33, the magnetic price elements 13 fit together edge-to-edge to form a flat and continuous surface which continues from the magnetic strips 11. Further magnetic price elements 13 are removably attached to indicate the different prices of the various products on the magnetic strips. In a preferred embodiment, two or three prices are indicated for each product, to set out prices for different sizes of products. Once all the magnetic price elements 13 are indicated for the products on the left side of the board, magnetic strips 11 are removably attached to the back portion 5 immediately to the right of the magnetic price elements 13 already in place. Once again the perfect fit allows for a flat continuous surface between the various magnetic pieces. Once the magnetic strips 11 for the other half of the products are attached, the magnetic price elements 13 are removably attached to the back portion 5, again indicating two or three prices for each product. Once all the magnetic pieces are removably attached, the entire front surface 40 of the support portion 5 is covered with a flat continuous surface (forming front surface 9 of menu board 1) which indicates the products 21 for sale and the prices 23 which they are sold.

Magnetic price elements 13, are then removed by applying pressure with a finger to the bottom half of the front surface 24 of the magnetic price element 13. The force exerted on the bottom portion will cause the top of the element to lift off back portion 5 because the magnet 27 fixed to the back 28 does not extend to the bottom edge 51. In other words, the bottom edge 29 of the magnet 27 acts as a fulcrum point and permits the magnetic price elements 13 to be easily removed without the use of tools that could damage the menu board 1 and its elements. By removing one magnetic price element 13, the adjacent magnetic strip 11 can be removed by grasping the right edge and pulling the strip off the back portion 5. Therefore by removing a first magnetic price element 13 by pressing the front portion 24 with a finger, all magnetic pieces can be removed easily. However, in a preferred embodiment, once the board 1 is completely covered with magnetic pieces, only the required changes are to be made subsequently, including changes in prices and changes in products. The entire board rarely has to be completely redone.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

The embodiments of the invention in which an exclusive property or privilege is claimed are defined as follows:

1. A menu board assembly, comprising:

a substantially planar support portion made of magnetically attractable material; and a plurality of magnetic elements removably attachable to the substantially planar support portion at any selected location thereon, each said magnetic element having a rectangular signage element with opposed top and bottom side edges, and opposed right and left side edges, each said rectangular signage element further comprising a front surface that is substantially planar from edge to edge in all directions and a back surface, a magnet fixed onto the back surface of each said signage element, each said magnet being smaller than the respective signage element and covering between one half and five sixths of the back surface and being disposed such that each said magnet is offset from both said top and bottom edges of said respective signage element, the magnet being closer to the top edge than to the bottom edge such that each said magnetic element is removable from the support portion by applying pressure to a section of the front surface of the signage element adjacent the bottom edge, causing an edge of the magnet closest to the bottom edge of the signage element to act as a fulcrum and thereby causing remaining portions of said magnet to be pivoted away from said support portion, said magnet being dimensioned and disposed such that, after the pivoting, the rear surface of the signage element adjacent the top edge is spaced further from the support portion than the front surface of an adjacent signage element, thereby allowing the rear surface of said signage element adjacent said top edge to be grasped.

2. The menu board assembly of claim 1, wherein the substantially planar front surface is substantially perpendicular and adjacent to each of the top, bottom, left, and right side edges, such that the front surface of one said signage element is substantially continuous with the front surface of another of said signage elements when two of said edges abut.

3. The menu board assembly of claim 2, wherein said magnetic elements each define identical thicknesses, and wherein said menu board assembly further comprises a margin surrounding said substantially planar support portion, said margin projecting from said substantially planar support portion by a distance substantially equal to the thickness of each said magnetic element.

4. The menu board assembly of claim 3, wherein the plurality of magnetic elements comprise a first plurality of the magnetic elements and a second plurality of magnetic elements, each magnetic element in the first plurality having signage element with a front surface defining a first surface area, each said magnetic element in said second plurality having a signage element with a front surface defining a second area, said second area being larger than said first area.

* * * * *